US009314081B2

(12) United States Patent
Van Der Veur

(10) Patent No.: US 9,314,081 B2
(45) Date of Patent: Apr. 19, 2016

(54) HAIR WRAP DEVICES AND METHODS

(71) Applicant: Savvy Curls, LLC, Park City, UT (US)

(72) Inventor: Tami Lynn Van Der Veur, Park City, UT (US)

(73) Assignee: Savvy Curls, LLC, Park City, UT (US)

( * ) Notice: Subject to any disclaimer, the term of this patent is extended or adjusted under 35 U.S.C. 154(b) by 0 days.

(21) Appl. No.: 14/623,675

(22) Filed: Feb. 17, 2015

(65) Prior Publication Data

US 2015/0250280 A1 Sep. 10, 2015

Related U.S. Application Data

(60) Provisional application No. 61/948,278, filed on Mar. 5, 2014.

(51) Int. Cl.

| | |
|---|---|
| ***A45D 7/00*** | (2006.01) |
| ***A45D 8/36*** | (2006.01) |
| *A45D 2/00* | (2006.01) |

(52) U.S. Cl.

CPC .. *A45D 7/00* (2013.01); *A45D 8/36* (2013.01); *A45D 2002/007* (2013.01); *A45D 2007/002* (2013.01); *A45D 2007/004* (2013.01)

(58) Field of Classification Search

CPC ..... A45D 2/362; A45D 2/18; A45D 2/146; A45D 2/2464; A45D 7/02; A45D 2007/002; A45D 2007/004; A45D 8/00; A45D 8/34; A45D 8/36; A45D 2002/003; A45D 2002/006; A45D 2002/007; A45D 2002/008; A45D 2/127; A45D 2/14; A45D 2/2442; A45D 2/36; A45D 7/00; A41D 20/00

USPC ..... 132/273, 200, 210, 212, 243–247, 252, 132/278, 54, 55, 229, 233, 122, 274, 276, 132/277, 207, 211, 203, 223, 270; 2/DIG. 11

See application file for complete search history.

(56) References Cited

U.S. PATENT DOCUMENTS

| | | | | | |
|---|---|---|---|---|---|
| 38,574 | A | * | 5/1863 | Edwards | A45D 8/38 132/55 |
| 107,130 | A | * | 9/1870 | Vogt et al. | A45D 8/38 132/55 |
| 337,642 | A | * | 3/1886 | Wells | A45D 8/38 132/55 |
| 894,762 | A | * | 7/1908 | Taylor | A45D 8/38 132/55 |
| 1,482,567 | A | * | 2/1924 | Volney | A45D 8/36 132/274 |
| 1,539,706 | A | * | 5/1925 | Wallman | A45D 8/36 132/273 |
| 1,928,960 | A | * | 10/1933 | Behr | A45D 8/00 132/255 |
| 2,262,478 | A | * | 11/1941 | Thompson | A45D 8/38 132/55 |

(Continued)

OTHER PUBLICATIONS

Michaela Noelle, Sep. 2, 2011, http://michaelanoelledesigns.blogspot.com/2011/09/almost-no-heat-curls.html, pp. 1-5.*

(Continued)

*Primary Examiner* — Tatiana Nobrega
(74) *Attorney, Agent, or Firm* — Snell & Wilmer L.L.P.

(57) ABSTRACT

The present disclosure provides devices and methods for wrapping and curling hair. For example, a hair wrap may comprise a first flexible tube that at least partially surrounds the user's head, wherein the first flexible tube comprises a first end, a second end, and a flat portion configured to surround the top of the user's head, forming material disposed inside the first flexible tube, and a connecting mechanism configured to operatively couple the first end and the second end.

2 Claims, 9 Drawing Sheets

(56) References Cited

U.S. PATENT DOCUMENTS

| | | | | | |
|---|---|---|---|---|---|
| 2,300,437 | A * | 11/1942 | Solomon | A45D 7/00 | 132/105 |
| 2,308,819 | A * | 1/1943 | McFadden | A45D 8/38 | 132/223 |
| 3,668,707 | A * | 6/1972 | Williams | A42B 1/16 | 132/212 |
| 4,745,933 | A * | 5/1988 | Saenger | A41G 3/0008 | 132/273 |
| 5,025,816 | A * | 6/1991 | Jones | A45D 2/20 | 132/245 |
| 5,144,968 | A * | 9/1992 | Rivera | A45D 2/18 | 132/247 |
| 5,233,704 | A * | 8/1993 | Booher | A41D 23/00 | 140/104 |
| 5,383,480 | A * | 1/1995 | Clyburn | A45D 2/00 | 132/203 |
| 5,423,091 | A * | 6/1995 | Lange | A45D 44/12 | 2/174 |
| 5,456,270 | A * | 10/1995 | Wong | A45D 8/00 | 132/210 |
| 5,694,954 | A * | 12/1997 | Habibi | A45D 2/14 | 132/211 |
| 5,816,265 | A * | 10/1998 | Ringo | A41G 5/00 | 132/55 |
| 6,263,512 | B1 * | 7/2001 | LeDonne | A41D 23/00 | 132/273 |
| 6,266,826 | B1 * | 7/2001 | Alfano | A42B 3/00 | 2/411 |
| 6,470,896 | B1 * | 10/2002 | Mensonides | A45D 8/36 | 132/200 |
| 6,502,245 | B1 * | 1/2003 | McBride | A42B 1/22 | 2/181 |
| 6,560,783 | B2 * | 5/2003 | Cannings | A45D 8/36 | 2/171 |
| 7,331,353 | B2 * | 2/2008 | Harvie | A45D 8/36 | 132/273 |
| 2012/0211021 | A1 * | 8/2012 | Hsu | A45D 8/38 | 132/276 |
| 2014/0000644 | A1 | 1/2014 | Baldwin et al. | | |
| 2014/0048094 | A1 * | 2/2014 | Carriedo | A45D 8/00 | 132/210 |

OTHER PUBLICATIONS

Annelise Rowe, Feb. 24, 2012, http://www.byebyebeehive.com/2012/02/curl-your-hair-without-heat.html, pp. 1-5.*

"Bye Bye Beehive," "A Hairstyle Blog: Curl Your Hair Without Heat" http://www.byebyebeehive.com/2012/02/curl-your-hair-without-heat.html?m=1 Feb. 24, 2012.

"SoCal Curls" https://web.archive.org/web/20130814095328/http://www.socalcurls.com/ Aug. 14, 2013.

* cited by examiner

Section C-C

HAIR WRAP DEVICES AND METHODS

CROSS-REFERENCE TO RELATED APPLICATION

This application is a non-provisional of U.S. provisional patent application Ser. No. 61/948,278, entitled "A hair wrap made with thermal insulating & forming material that works with body heat producing beautiful curls," filed on Mar. 5, 2014, which is incorporated herein by reference.

FIELD OF THE DISCLOSURE

The present disclosure relates to hair wrapping devices and methods and, more particularly, to hair wrapping devices and methods that curl hair.

BACKGROUND OF THE DISCLOSURE

Most electrical hairstyling devices, as well as devices using artificial sources of heat, are costly, uncomfortable, and require high levels of heat to produce curls. Use of high-temperature hairstyling can lead to hair damage, including hair splitting, hair breaking, and color fading. Sponge rollers and other heatless curling devices may be unsightly or uncomfortable and often produce kinky or uneven curls. Thus, cost-effective and stylish technology that curls hair without reliance on artificial or high-temperature heat sources is desirable.

SUMMARY OF THE DISCLOSURE

In general, the present disclosure provides devices and methods for wrapping and curling hair. In various embodiments, the present disclosure provides a hair wrap comprising a flexible tube having and first end and a second end, forming material disposed inside the tube, and a connecting mechanism configured to operatively couple the first end and the second end. In various embodiments, the forming material may form at least a portion of the flexible tube into an elliptical or non-elliptical shape. In various embodiments, the hair wrap may be comprised of thermal or moisture wicking materials or the diameter of the hair wrap may be adjustable. In various embodiments, the hair wrap may have a second or third band.

In various embodiments, the present disclosure provides methods for wrapping hair. In various embodiments, these methods may include separating portions of hair and wrapping the portions of hair around the hair wrap. In various embodiments, these methods may additionally include securing wrapped hair with a hair pin.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure.

DETAILED DESCRIPTION

Figure 1A:
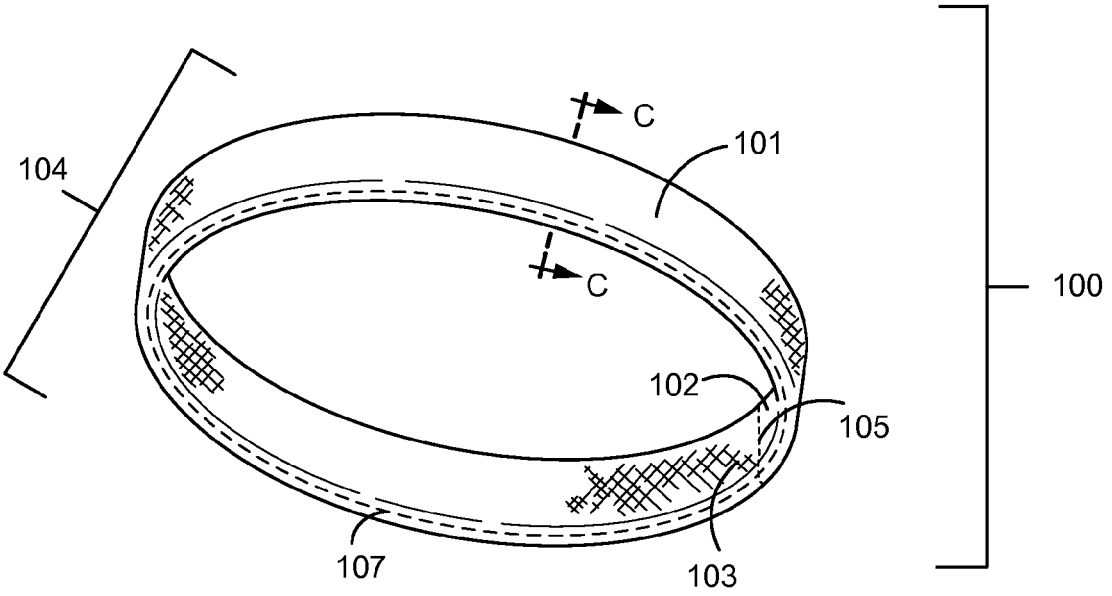
FIG. 1*a* illustrates a perspective view of a hair wrapping device in accordance with various embodiments.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical and mechanical changes may be made without departing from the spirit and scope of the disclosure. Thus, the detailed description herein is presented for purposes of illustration only and not of limitation.

For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

For example, in the context of the present disclosure, the device hereof finds particular use in connection with curling hair, and the specific characteristics of each embodiment may be adapted to be optimized for performance on long hair. However, generally speaking, numerous applications of the present disclosure may be realized, for purposes including, without limitation, curling hair, styling hair, and securing hair.

Likewise, numerous materials may be used to achieve each element of the device disclosed herein. Generally speaking, elements of the disclosure may be made of various materials and fabrics including, without limitation, nylon, polyester, GORE-TEX (polytetrafluoroethylene by W.L. Gore & Associates), cotton, fleece, flannel, polyurethane, rice, beans, flax, sodium acetate solution, and the like. That being said, although an exhaustive list of materials is not included herein, one skilled in the relevant art will appreciate that various conventional materials and fabrics may be used, all of which fall within the scope of the present disclosure. Additionally, various materials may be combined to achieve the most attractive characteristics of existing, or as yet unknown, fabrics, thermal materials, moisture wicking materials, and composite materials, and may be incorporated into the elements disclosed herein, whose combined characteristics may potentially increase comfort, aesthetic quality, cost efficiency, or quality of curl.

As used herein, the terms "clockwise," "counter-clockwise," "left," and "right" are all from the perspective of a user of a hair wrapping device of the present disclosure.

The foregoing being noted, in accordance with various embodiments of the present disclosure, a hair wrap for a user's head may comprise a first flexible tube that at least partially surrounds the user's head, wherein the first flexible tube comprises a first end, a second end, and a flat portion configured to surround the top of the user's head, forming material disposed inside the first flexible tube, and a connecting mechanism configured to operatively couple the first end and the second end. Briefly, these features of the present disclosure are provided in order that the detailed description herein will be better understood and appreciated; however, the present disclosure can also comprise additional features, which will be subsequently described herein.

For example, with reference to FIG. 1*a*, a hair wrap 100 may comprise a first flexible tube 101. In various embodiments, the first flexible tube 101 may be circular. The first flexible tube 101 may be configured to at least partially surround a user's head and may be worn by a user over or under the user's hair. The first flexible tube 101 may further comprise a first end 102 and a second end 103 disposed at opposite ends of the first flexible tube 101. The first flexible tube 101 may further comprise a flat portion 104 disposed between the first end 102 and the second end 103. The flat portion 104 may be configured to partially surround the top of the user's head and/or the user's forehead. The flat portion 104 may or may not contain any forming material. The flat portion 104 may further comprise a diameter-adjusting mechanism. In various embodiments, the first flexible tube may comprise an interior side opposite an exterior side, and a top side opposite a bottom side.

In various embodiments, the first flexible tube may be made of any flexible material such as nylon, polyester, GORE-TEX (polytetrafluoroethylene by W.L. Gore & Associates), cotton, fleece, wool, silk, linen, polyurethane, or the like. In various embodiments, the first flexible tube may be made of any material capable of retaining and gradually dissipating heat. In various embodiments, the first flexible tube may be made of any material capable of drying quickly or wicking moisture away from the user's head or hair.

In various embodiments, the flat portion may comprise between about ten percent and about sixty percent, more preferably between about 10 percent and about 30 percent, and most preferably about 20 percent, of the first flexible tube's circumference. The flat portion may increase the aesthetic appeal of the hair wrap. In various embodiments, the hair wrap may allow the curling of short bangs, fringe, or the hair adjacent to the user's forehead and less than three inches from the user's scalp. In various embodiments, the flat portion may preclude the curling of short bangs, fringe, or the hair adjacent to the user's forehead and less than three inches from the user's scalp.

Figure 1B:
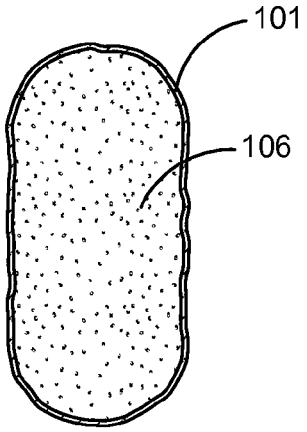
FIG. 1*b* illustrates a cross section view of a hair wrapping device in accordance with various embodiments.

With reference to FIG. 1*b*, an illustration of the C-C cross-section of hair wrap 100 is provided. The hair wrap 100 may further comprise forming material 106 disposed within the first flexible tube. The forming material 106 may be configured to give the first flexible tube 101 a circular cross-sectional shape. In various embodiments, the forming material may be configured to give the first flexible tube a generally elliptical (e.g., circles, ovals, ellipses, and the like) or non-elliptical (e.g., triangles, rectangles, squares, hexagons, trapezoids, pentagons, stars, and the like), or random cross-sectional shape. The forming material 106 may be configured to give the first flexible tube 101 various cross-sectional diameters or widths, and the cross-sectional diameter or width of the forming material 106 may vary across different portions of the hair wrap 100. For example, in various embodiments, the forming material 106 may have a smaller diameter or a lower profile in the flat portion 104 of the hair wrap 100. In this regard, as noted above, the flat portion 104 may or may not contain any forming material.

In various embodiments, the forming material may be made of any flexible material such as nylon, polyester, GORE-TEX (polytetrafluoroethylene by W.L. Gore & Associates), cotton, fleece, wool, silk, linen, polyurethane, rice, beans, wheat, flax seed, sodium acetate solution, or the like. In various embodiments, the forming material may comprise an inflatable member such as a bladder, balloon, or similar device. The inflatable member may be at least partially inflated with air, sodium acetate, or a similarly suitable gas or liquid. The forming material and the first flexible tube may be made of the same material or different materials. In various embodiments, the forming material may be made of any material capable of retaining and gradually dissipating heat, drying quickly, or wicking moisture away from the user's head or hair.

That being said, one skilled in the relevant are will appreciate that the forming material may be configured in any manner and made of any material that aids in forming a desirable diameter of hair curls so that the curls produced are plump and round in shape.

While in various embodiments the hair wrap 100 may comprise a unitary construction, in various other embodiments, and with reference back to FIG. 1*a*, the hair wrap 100 may further comprise a connecting mechanism 105 configured to operatively couple the first end 102 and the second end 103. The connecting mechanism 105 may comprise a threaded seam, snap, clasp, tie, hook and eye, button, adhesive, or any similar mechanism for operatively coupling the first end 102 and the second end 103. In various embodiments, the hair wrap 100 may comprise a circumferential connecting mechanism 107. The circumferential connecting mechanism 107 may comprise a threaded seam, adhesive, or a plurality of snaps, clasps, ties, hooks and eyes, buttons, or any similar mechanism.

In various embodiments, at least one of the first end 102, the second end 103, the connecting mechanism 105, and the circumferential connecting mechanism 107 may be configured to reversibly open and close such that the forming material 106 disposed inside the first flexible tube 101 may be removed and/or replaced. For example, the forming material may comprise a material capable of being heated within the hair wrap, or in other embodiments externally to the hair wrap and placed within the hair wrap, prior to placement on a user's head. For example, the forming material may be removed prior to laundering the hair wrap. For example, a first forming material may be removed and replaced with a second forming material of a different type. For example, the forming material may be removed and replaced as a result of degradation or wear and tear.

Figure 2:
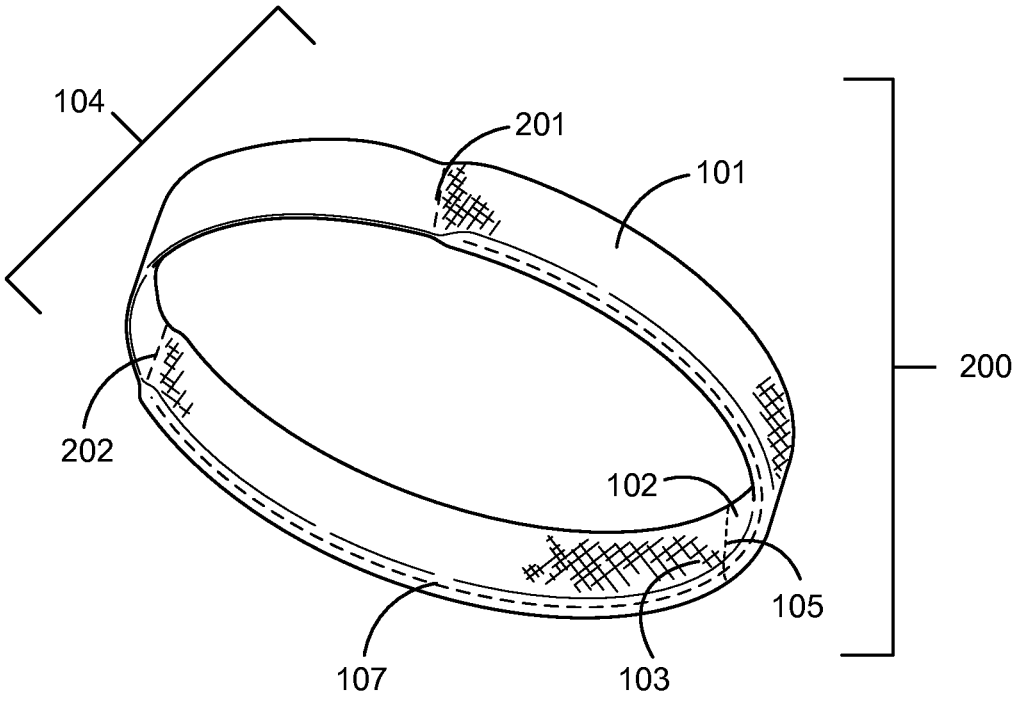
FIG. 2 illustrates a perspective view of a hair wrapping device in accordance with various embodiments.

In various embodiments and with reference to FIG. 2, a hair wrap 200 may comprise a left seam 201 and a right seam 202. The seams 201, 202 may comprise a threaded seam, an adhesive, or the like. The seams 201, 202 may be configured to preclude forming material from becoming disposed with the flat portion 104 of the first flexible tube 101. In various embodiments, threaded seams may be disposed at any point or a plurality of points along the hair wrap, may operatively couple the forming material to the first flexible tube, or may couple opposite sides of the first flexible tube as an instrumentality of baffling, such that movement of the forming material or accumulation of the forming material in a portion of the first flexible tube is minimized or precluded. In various embodiments, other instrumentalities of baffling may be employed such as valves, flaps, walls, or the like.

Figure 3:
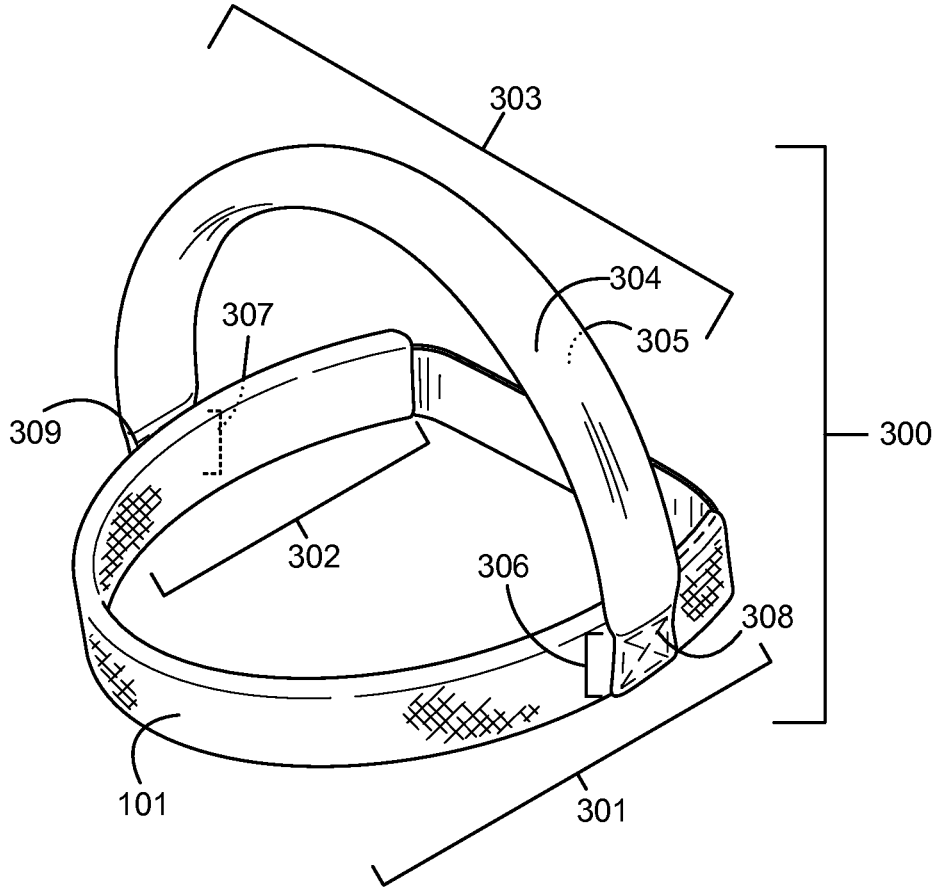
FIG. 3 illustrates a perspective view of a hair wrapping device in accordance with various embodiments.

In various embodiments and with reference to FIG. 3, a hair wrap 300 may comprise at least two bands. For example, a first flexible tube 101 may be configured to at least partially surround a user's head. The first flexible tube 101 may further comprise a left side 301, a right side 302, and a second band 303. The second band 303 may comprise a second flexible tube 304, a second band left end 306, and a second band right end 307. In various embodiments, the second band 303 may further comprise forming material 305 disposed inside the second flexible tube 304. The hair wrap 300 may further comprise a left connecting mechanism 308 configured to detachably connect the left side 301 of the first flexible tube 101 and the second band left end 306, and a right connecting mechanism 309 configured to detachably connect the right side 302 of the first flexible tube 101 and the second band right end 307.

In various embodiments, the second flexible tube 304 and the forming material 305 disposed therein may be made of various materials already described, and may vary in diameter or thickness. The left connecting mechanism 308 may be configured to detachably connect the left side of the hair wrap 300 to the left end of the second band, and the right connecting mechanism 309 may be configured to detachably connect the right side of the hair wrap 300 to the left end of the second band. In various embodiments, left connecting mechanism 308 and right connecting mechanism 309 may comprise a threaded seam, snap, clasp, tie, hook and eye, button, adhesive, or any similar mechanism for operatively coupling a second band or third band to the first flexible tube. In various embodiments, the hair wrap may have a third band comprising a third flexible tube, forming material disposed inside the third flexible tube, a left end, and a right end.

Figure 4:
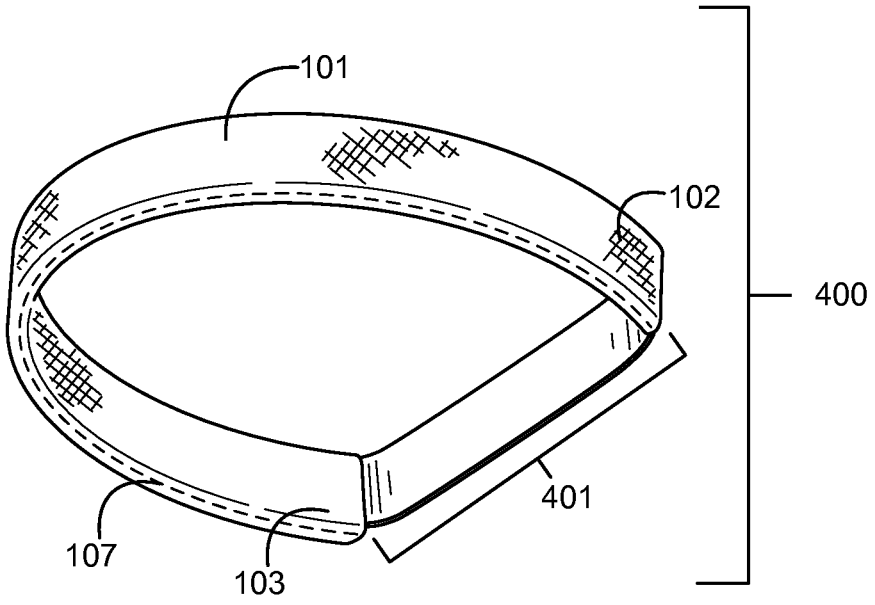
FIG. 4 illustrates a perspective view of a hair wrapping device.

In various embodiments and with reference to FIG. 4, a hair wrap 400 may further comprise a diameter-adjusting mechanism 401. The diameter-adjusting mechanism may be disposed on a flat portion of the hair wrap. The diameter-adjusting mechanism 401 may be disposed between the first end 102 and the second end 103. The diameter-adjusting mechanism 401 may be configured to fit the hair wrap 400 snugly around users' heads of varying diameter. In various embodiments, the diameter-adjusting mechanism 401 may comprise elastic, an adjustable belt, a plurality of snaps, clasps, ties, hook and eyes, or buttons, or any similar mechanism for adjusting the diameter of the hair wrap 400.

In various embodiments, the hair wrap may further comprise an instrumentality of electrically heating the forming material. For example, the forming material may be a heating element. Alternatively, a heating element may be disposed within the forming material, adjacent to the forming material, or otherwise in connection with the forming material. The heating element may be battery operated or configured to connect to an electrical outlet or charging mechanism to increase the temperature of the hair wrap prior to placement on a user's head or during use.

Figure 5A:
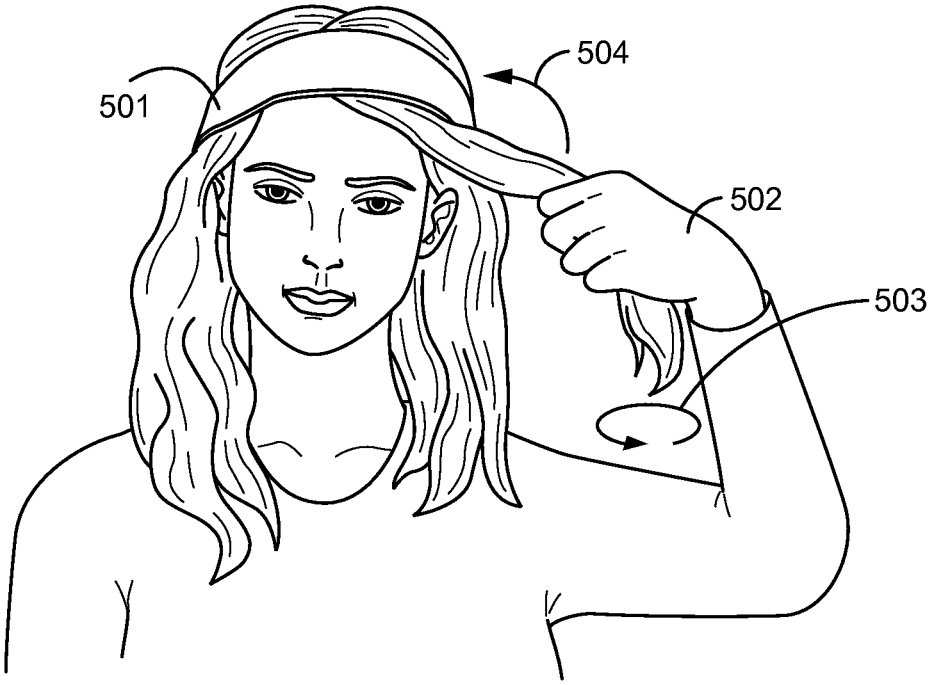
FIG. 5*a* illustrates a user performing a step of method of wrapping hair with an example hair wrapping device.

In various embodiments of the present disclosure, methods for wrapping hair are provided. For example and with reference to FIG. 5*a*, hair may be wrapped by providing a hair wrap, placing the hair wrap on a user's head such that the hair wrap surrounds the user's head and hair (Step 501), separating a first portion of hair (Step 502), twisting the first portion of hair (Step 503), and wrapping the first portion of hair at least once around the hair wrap (Step 504). In various embodiments, the hair wrap may be placed on a user's head such that the first flexible tube surrounds the user's head proximate the hairline and the interior side of the first flexible tube covers a portion of the hair while other portions of the hair extend below the bottom side of the first flexible tube. The hair may be wrapped in a transverse direction, such that the first portion of hair encircles a portion of a first flexible tube. In various embodiments, the hair may be wrapped such that the first portion of hair extends across the exterior side of the first flexible tube in an upward direction from the bottom side to the top side, extends in a downward direction from the top side to the bottom side across the interior side of the first flexible tube, and extends downward such that a remaining length of hair extends below the bottom side. In various embodiments, the hair may be wrapped at least 360 degrees, 720 degrees, 1080 degrees, 1440 degrees or more around the hair wrap. The twisting step may be accomplished by rotating the first portion of hair at least 360 degrees about an axial centerline of the first portion of hair.

In various embodiments, the user may shampoo, condition, or apply a hair styling agent to the hair prior to wrapping. For example, mousse may be applied to the hair prior to wrapping. The user's hair may be dry or damp prior to wrapping. In various embodiments, hair that is nearly dry as a result of air drying, towel drying, blow drying, or the like may be wrapped. The user may wrap hair for various lengths of time, and may exercise or sleep while wearing a hair wrap. In various embodiments, the hair wrap may be worn until the user's hair is completely dry. In various embodiments, at least one portion of hair may be wrapped around the hair wrap in an ornamental or decorative fashion.

In various embodiments, sections of hair may vary in volume. For example, a section of hair that is one inch in width as it lies on the user's head may be wrapped; however, sections of any width or volume may be wrapped. Larger sections of hair may be wrapped to produce curls with a larger diameter. Likewise, smaller sections of hair may be wrapped to product curls with a smaller diameter.

Figure 5B:
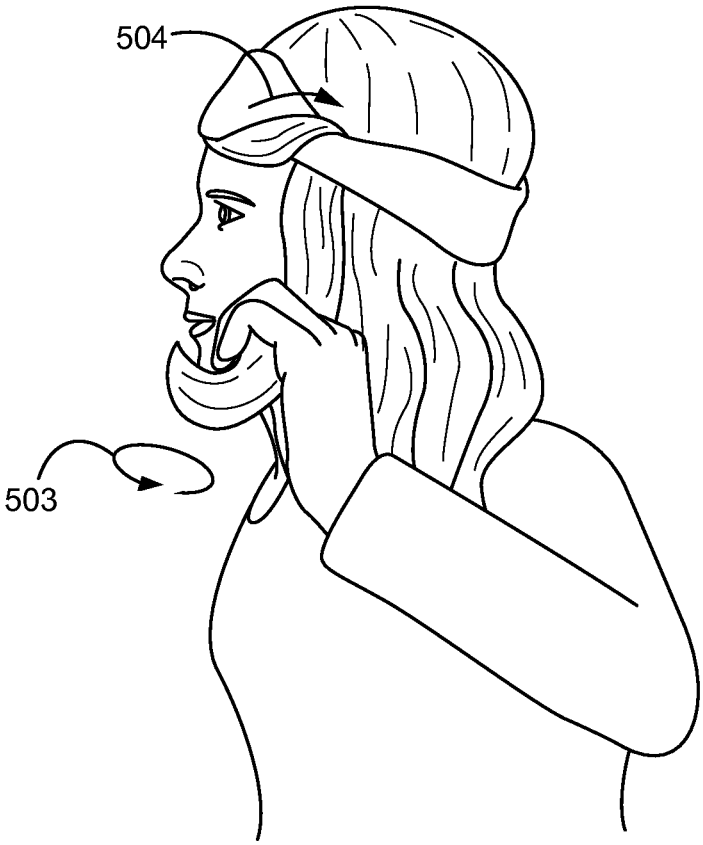
FIG. 5*b* illustrates a user performing another step of method of wrapping hair with an example hair wrapping device.
Figure 5C:
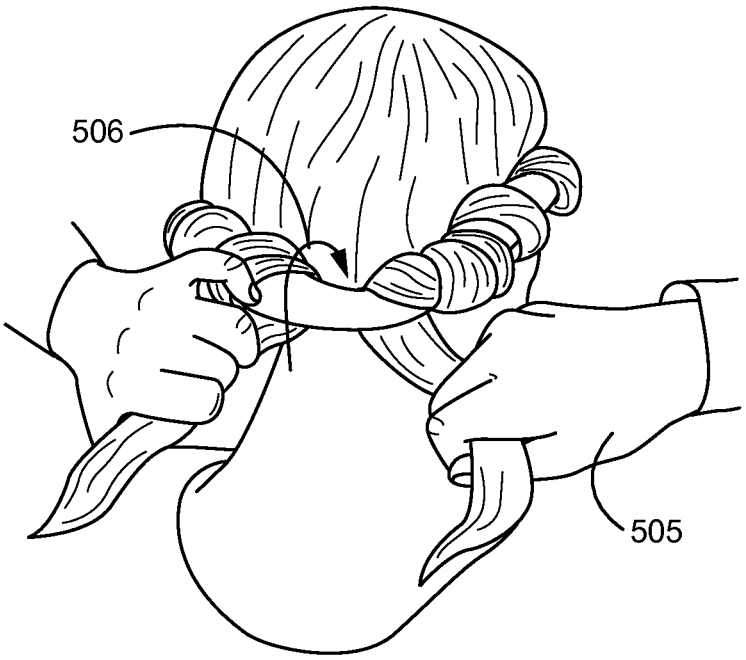
FIG. 5*c* illustrates a user performing yet another step of method of wrapping hair with an example hair wrapping device.

In various embodiments and with reference to FIGS. 5*b* and 5*c*, a method of wrapping hair is provided. The method may comprise providing a hair wrap, placing the hair wrap on a user's head such that the hair wrap surrounds the user's head and hair, separating a first portion of hair disposed on the left anterior side of the user's head, twisting the first portion of hair (Step 503), and wrapping the first portion of hair at least 360 degrees around the hair wrap in a clockwise direction (Step 504). The method may further comprise separating a second portion of hair from the left side of the user's head and posterior to the first portion of hair, joining the first portion of hair and the second portion of hair, repeating the steps of twisting, wrapping, separating, and joining until all of the user's hair disposed left of a user's sagittal plane has been wrapped around the hair wrap at least 360 degrees.

The method may further comprise separating a third portion of hair from the right anterior side of the user's head, twisting the third portion of hair, wrapping the third portion of hair 360 degrees around the hair wrap in a counter-clockwise direction, separating a fourth portion of hair from the right side of the user's head and posterior to the third portion of hair, joining the third portion of hair and the fourth portion of hair, repeating the four immediately preceding steps of twisting, wrapping, separating, and joining until all of the user's hair disposed right of the sagittal plane has been wrapped around the hair wrap at least 360 degrees. The method may further comprise joining any hair not yet wrapped around the hair wrap (Step 505), and wrapping it around the hair wrap (Step 506). Various methods of wrapping hair may produce curls that rotate away from the user's face.

The hair may be secured by hair pins, hair clips, bobby pins, or the like. The hair may be subsequently unwrapped. In various embodiments, each section of hair may be unwrapped in the reverse order of initial wrapping. Hair may be brushed after unwrapping and various styling agents may be applied to the hair after unwrapping.

In various embodiments, the hair may be re-wrapped while the user baths, exercises, or sleeps. Re-wrapping hair in lieu of washing hair may preserve or improve the desirability of curls. In various embodiments, the hair may be unwrapped after ten minutes; however the hair may be unwrapped after it has cooled or dried, or at any other suitable time.

Figure 6A:
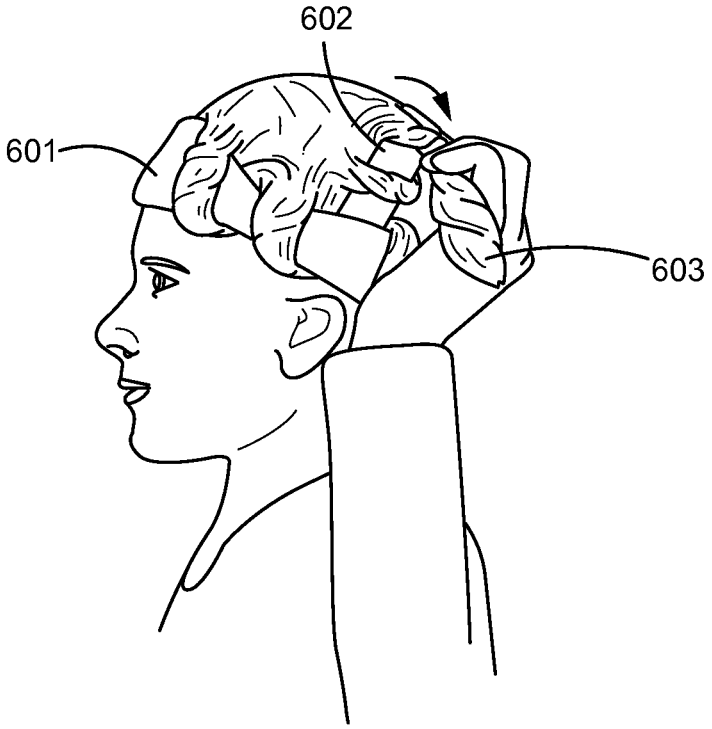
FIG. 6*a* illustrates a user performing a step of method of wrapping hair with an example hair wrapping device comprising a second band.
Figure 6B:
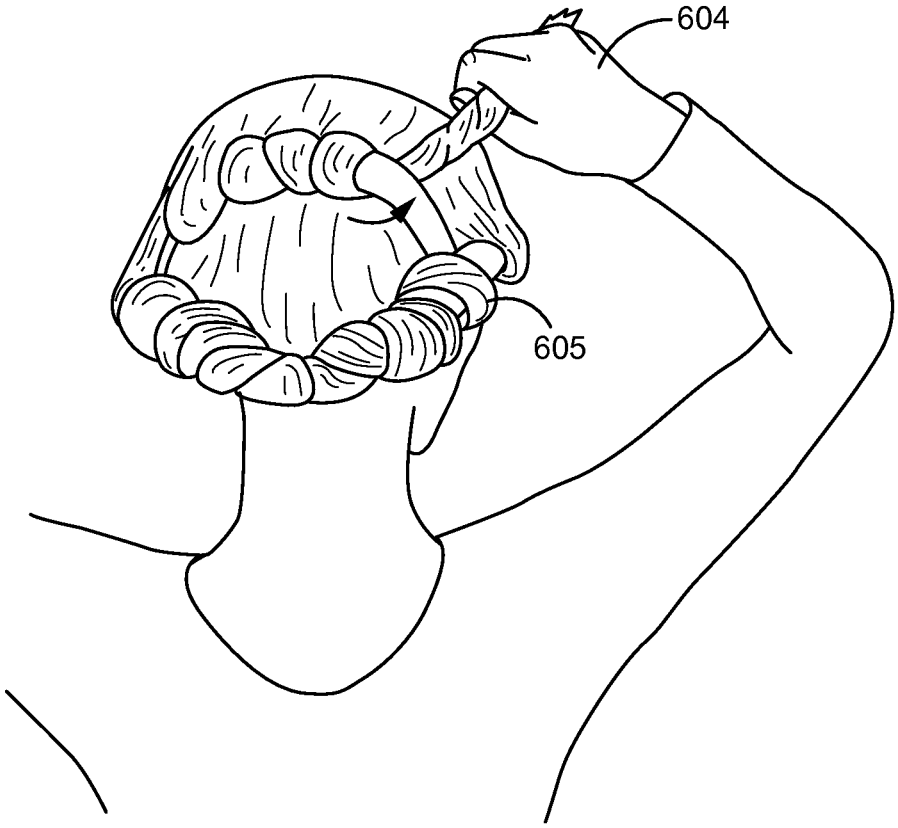
FIG. 6*b* illustrates a user performing another step of method of wrapping hair with an example hair wrapping device comprising a second band.

In various embodiments and with reference to FIGS. 6*a* and 6*b*, another method of wrapping hair is provided. The method may produce curls that rotate toward the user's face. For example, a method may comprise placing the hair wrap on a user's head such that the hair wrap surrounds the user's head and is disposed inferior of the user's hairline (Step 601), separating a first portion of hair disposed on the left anterior side of the user's head, twisting the first portion of hair, wrapping the first portion of hair at least 360 degrees around the hair wrap in a counter-clockwise direction. In various embodiments, the hair wrap may be placed on a user's head such that the first flexible tube surrounds the user's head proximate the hair line, and a portion of the user's hair extends over the exterior side of the first flexible tube while other portions of the hair extend below the bottom side of the first flexible tube. In various embodiments, the wrapping may comprise wrapping the first portion of hair at least 360 degrees around the first flexible tube in a transverse, counter-clockwise direction such that the first portion of hair extends across the exterior side of the first flexible tube in a downward direction from the top side to the bottom side, and extends in an upward direction from the bottom side to the top side across the interior side of the first flexible tube. The method may further comprise separating a second portion of hair from the left side of the user's head and posterior to the first portion of hair, joining the first portion of hair and the second portion of hair, repeating the steps of twisting, wrapping, separating, and joining until all of the user's hair disposed left of a user's sagittal plane has been wrapped around the hair wrap at least 360 degrees.

The method may further comprise separating a third portion of hair from the right anterior side of the user's head, twisting the third portion of hair, wrapping the third portion of hair 360 degrees around the hair wrap in a clockwise direction, separating a fourth portion of hair from the right side of the user's head and posterior to the third portion of hair, joining the third portion of hair and the fourth portion of hair, repeating the four immediately preceding steps of twisting, wrapping, separating, and joining until all of the user's hair disposed right of the sagittal plane has been wrapped around the hair wrap at least 360 degrees. The method may further comprise joining any hair not yet wrapped around the hair wrap and wrapping it around the hair wrap.

In various embodiments, hair may be wrapped to produce additional curls at the crown of a user's head. For example, a method may comprise providing a hair wrap with at least a first flexible tube and a second band. In various embodiments, the second band may extend laterally between a left side of the first flexible tube and a right side of the first flexible tube. The method further comprises placing the hair wrap on a user's head such that the hair wrap surrounds the user's head and is disposed inferior of the user's hairline. In various embodiments, the hair wrap may be placed on a user's head such that the first flexible tube surrounds the user's head proximate the hairline and the interior side of the first flexible tube covers a portion of the hair while other portions of the hair extend below the bottom side of the first flexible tube, and the second band is disposed along a crown portion of the user's head. In various embodiments, the hair wrap may be placed on a user's head such that the first flexible tube surrounds the user's head proximate the hair line, a portion of the user's hair extends over the exterior side of the first flexible tube while other portions of the hair extend below the bottom side of the first flexible tube, and the second band is disposed along a crown portion of the user's head. The method may further comprise separating a crown section of the user's hair, and disposing the crown section anterior to the second band and anterior to the first flexible tube (Step 602). In various embodiments, the crown portion may be disposed anterior to the second band and posterior to a portion of the first flexible tube disposed at the front of the user's head. In various embodiments, the crown portion may be disposed posterior to the second band and anterior to a portion of the first flexible tube disposed at the back of the user's head. In various embodiments, the method further comprises separating a first crown portion of hair from the crown section, twisting the first crown portion of hair, wrapping the first crown portion of hair once around the second band, separating a second crown portion of hair from the crown section (Step 603), joining the first crown portion of hair and the second crown portion of hair, repeating the four immediately preceding steps of twisting, wrapping, separating, and joining steps until all of the crown section of hair has been wrapped around the second band (Step 604), and performing a hair wrapping method previously described with the remainder of the user's hair (Step 605).

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Devices and methods are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

I claim:

1. A method of wrapping hair comprising:

providing a hair wrap, wherein the hair wrap comprises a circular, first flexible tube having an interior side opposite an exterior side and a top side opposite a bottom side, and a second band extending laterally between a left side of the first flexible tube and a right side of the first flexible tube;

placing the hair wrap on a user's head such that the first flexible tube surrounds the user's head proximate the hairline and the interior side of the first flexible tube covers a portion of the hair while other portions of the hair extend below the bottom side of the first flexible tube, and the second band is disposed along a crown portion of the user's head;

separating a crown section of the user's hair;

disposing the crown section posterior to the second band and anterior to a portion of the first flexible tube disposed at the back of the user's head;

separating a first crown portion of hair from the crown section;

twisting the first crown portion of hair;

wrapping the first crown portion of hair at least 360 degrees transversely around the second band;

separating a second crown portion of hair from the crown section;

joining the first crown portion of hair and the second crown portion of hair;

repeating the four immediately preceding steps of twisting, wrapping, separating and joining until all of the crown portions of hair have been wrapped around the second band;

separating a first portion of hair, wherein the first portion of hair is disposed on the left anterior side of the user's head;

twisting the first portion of hair;

wrapping the first portion of hair at least 360 degrees around the first flexible tube in a clockwise, transverse direction such that the first portion of hair extends across the exterior side of the first flexible tube in an upward direction from the bottom side to the top side, extends in a downward direction from the top side to the bottom side across the interior side of the first flexible tube, and extends downward such that a remaining length of hair extends below the bottom side;

separating a second portion of hair from the left side of the user's head and posterior to the first portion of hair;

joining the first portion of hair and the second portion of hair;

repeating the steps of twisting, wrapping, separating, and joining until all of the user's hair disposed left of a user's sagittal plane has been wrapped around the first flexible tube at least once;

separating a third portion of hair from the right anterior side of the user's head;

twisting the third portion of hair;

wrapping the third portion of hair at least 360 degrees around the first flexible tube in a transverse, counterclockwise direction such that the third portion of hair extends across the exterior side of the first flexible tube in an upward direction from the bottom side to the top side, extends in a downward direction from the top side to the bottom side across the interior side of the first flexible tube, and extends downward such that a remaining length of hair extends below the bottom side;

separating a fourth portion of hair from the right side of the user's head and posterior to the third portion of hair;

joining the third portion of hair and the fourth portion of hair;

repeating the four immediately preceding steps of twisting, wrapping, separating, and joining until all of the user's hair disposed right of the sagittal plane has been wrapped around the first flexible tube at least once; and joining any hair not yet wrapped around the hair wrap and wrapping it around the hair wrap.

2. A method of wrapping hair, comprising:

providing a hair wrap, wherein the hair wrap comprises a circular, first flexible tube having an interior side opposite an exterior side and a top side opposite a bottom side, and a second band extending laterally between a left side of the first flexible tube and a right side of the first flexible tube;

placing the hair wrap on a user's head such that the first flexible tube surrounds the user's head proximate the hair line, a portion of the user's hair extends over the exterior side of the first flexible tube while other portions of the hair extend below the bottom side of the first flexible tube, and the second band is disposed along a crown portion of the user's head;

separating a crown section of the user's hair;

disposing the crown section anterior to the second band and posterior to a portion of the first flexible tube disposed at the front of the user's head;

separating a first crown portion of hair from the crown section;

twisting the first crown portion of hair;

wrapping the first crown portion of hair at least 360 degrees transversely around the second band;

separating a second crown portion of hair from the crown section;

joining the first crown portion of hair and the second crown portion of hair;

repeating the four immediately preceding steps of twisting, wrapping, separating, and joining until all of the crown portions of hair have been wrapped around the second band;

separating a first portion of hair, wherein the first portion of hair is disposed on the left anterior side of the user's head;

twisting the first portion of hair;

wrapping the first portion of hair at least 360 degrees around the first flexible tube in a transverse, counterclockwise direction such that the first portion of hair extends across the exterior side of the first flexible tube in a downward direction from the top side to the bottom side, and extends in an upward direction from the bottom side to the top side across the interior side of the first flexible tube;

separating a second portion of hair from the left side of the user's head and posterior to the first portion of hair;

joining the first portion of hair and the second portion of hair;

repeating the steps of twisting, wrapping, separating, and joining until all of the user's hair disposed left of a sagittal plane has been wrapped around the first flexible tube at least once;

separating a third portion of hair from the right anterior side of the user's head;

twisting the third portion of hair;

wrapping the third portion of hair at least 360 degrees around the first flexible tube in a transverse, clockwise direction such that the first portion of hair extends across the exterior side of the first flexible tube in a downward direction from the top side to the bottom side, and extends in an upward direction from the bottom side to the top side across the interior side of the first flexible tube;

separating a fourth portion of hair from the right side of the user's head and posterior to the third portion of hair;

joining the third portion of hair and the fourth portion of hair;

repeating the four immediately preceding steps of twisting, wrapping, separating, and joining until all of the user's hair disposed right of the sagittal plane has been wrapped around the first flexible tube at least once; and joining any hair not yet wrapped around the hair wrap and wrapping it around the hair wrap.

* * * * *